United States Patent [19]

Johns

[11] 3,960,408

[45] June 1, 1976

[54] TUNNEL LAYOUT FOR LONGWALL MINING USING SHIELDS

[75] Inventor: Robert W. Johns, Calgary, Canada

[73] Assignee: World Oil Mining Ltd., Calgary, Canada

[22] Filed: Oct. 28, 1975

[21] Appl. No.: 625,888

Related U.S. Application Data

[62] Division of Ser. No. 509,489, Sept. 26, 1974.

[30] Foreign Application Priority Data

Mar. 18, 1974 Canada ..... 195228

[52] U.S. Cl. ..... 299/19

[51] Int. Cl.[2] ..... E21C 27/24

[58] Field of Search ..... 299/11, 18, 19, 33

[56] References Cited

UNITED STATES PATENTS

| | | | |
|---|---|---|---|
| 2,891,778 | 6/1959 | Milik | 299/19 X |
| 3,778,108 | 12/1973 | Pennington et al. | 299/11 |
| 3,887,235 | 6/1975 | Koppers | 299/19 X |

FOREIGN PATENTS OR APPLICATIONS

| | | | |
|---|---|---|---|
| 1,078,513 | 12/1956 | Germany | 299/11 |

*Primary Examiner*—Ernest R. Purser
*Attorney, Agent, or Firm*—McLaws & Company

[57] ABSTRACT

In the underground mining of friable mineral deposits such as bituminous sands, method and apparatus are disclosed in which a working crosscut in the mineral deposit, is established, connecting two parallel operating tunnels, the front wall of the crosscut being unsupported and forming the mining wall, the roof and rear wall of the working crosscut being supported by a novel mining shield comprising a plurality of forwardly inclined, base supported arch members positioned in adjacent abutting relationship and each independently advanceable towards the mining wall. A conventional mining machine is employed under the mining shield in the working crosscut, operating across the full width of the mining wall. As the mining machine removes a cut, apparatus upon the mining machine advances individual mining arch sections forwardly into the mining face the depth of the cut, leaving the backs unsupported and free to collapse behind the advancing mining shield. The procedure continues until a blocked-out section of the mineral deposit is traversed. The mining operation being successively repeated in the collapsed mineral material until the mineral deposit is mined out.

6 Claims, 23 Drawing Figures

TUNNEL LAYOUT FOR LONGWALL MINING USING SHIELDS

This is a a division of application Ser. No. 509,489, filed Sept. 26, 1974.

BACKGROUND OF THE INVENTION

This invention relates to a method and apparatus for the underground mining of bituminous sands, oil shales and other friable mineral deposits.

The recovery of petroleum from naturally occurring bodies of bituminous sands and shales has long presented problems of practical significance because of the mining problem involved. In for example the Athabasca area of Alberta, Canada, there occur extensive deposits of sediments, known as the "McMurray sediments," which are deposited on Pre-Cretaceous erosion surfaces generally of Devonian limestone. The sediments comprise relatively coarse sands, overlain by a mantle of glacial drift, which varies in depth from a few feet adjacent the Athabasca river, to in excess of 1,800 feet at a distance of several miles from the Athabasca river.

The McMurray sediments extend over approximately 9,000 square miles, in only approximately 7% of which is the overburden less than 100 feet in depth, and in only 20% of this area is it less than 250 feet (Alberta Oil & Gas Conservation Board "A Description and Reserve Estimate of the Oil Sands of Alberta, 1963").

At some time during the geological history of the McMurray sediments, they were invaded by some 600 billion barrels of oil. The McMurray sediments themselves extend from 100 to 200 feet in thickness, and the oil content of the sediments is roughly one barrel of oil per cubic yard of sands; one cubic yard of oil-saturated sand weighs approximately 1 ton.

The top of the McMurray formation is relatively flat, and its varying thickness is due to the topography of the Pre-Cretaceous erosional surface on which it rests.

Heretofore, two separate and distinct approaches have been used, or conceived in exploiting the McMurray oil sands. Initially, and to date the only commercial method has been that of surface mining of the sands, in which a location is selected where the overburden does not extend to a depth greater than approximately 20 feet. The overburden is stripped with draglines or scrapers, to expose the top of the oil sands, and various mining techniques are then employed in order to mine the sands, which are then transported by conveyor mine trucks to a separation plant, for separarating the oil from the coarse sands. Large shovels, mining wheels, rippers and scrapers have heretofore been employed in the mining process. The Great Canadian Oil Sands Ltd. plant at Mildred Lake, Alberta, utilizes large mining wheels, mounted in outboard fashion on booms, in which cutter-equipped buckets are rotated around a wheel, the cutters engaging the exposed oil sands face on a mining bench, each cutter-equipped bucket slicing a cut of several inches of sand from the face.

The economics of such surface mining procedures have restricted the operations to areas of relatively low overburden, and it has generally been conceived that development of the major portion of the oil sands must depend on in situ methods. Such in situ methods have been experimental, and generally have involved underground combustion or solution mining, in which a diluent such as kerosene, is injected into the formation through input boreholes for recovery of the diluent and entrained oil from adjacent output boreholes. Although the economic results of such in situ methods have not been published, it is generally believed that such methods are not commercially practicable because of the relatively high losses of the recovery agents employed.

The heavy asphaltic oil in the oil sands is the bonding agent which consolidates the sand into a quasi-sandstone. The oil is heavy gravity (from 8° API to 12°API), viscous especially at low temperatures; the formation temperature of the oil sands is around 40°F.

Although the oil has much the same general properties throughout the formation, there are some differences. In the McMurray area, the oil has specific gravities of 1.020 to 1.025 and is much more viscous than the oil from elsewhere in the formation, where the oil has specific gravities of 1.005 to 1.010. Oil of specific gravities of 1.000 or somewhat less have been observed at the bottom of the formation.

The only commercial plant to date in the McMurray area, that of Great Canadian Oil Sands Ltd., has a design capacity of 100,000 tons per day of mined sand. Engineering estimates of optimum plant sizes suggest that only large scale operation of at least 100,000 tons of sand per day can be expected to reduce unit costs to the point where the recovered bitumen will be competitive with conventionally obtained crude oil.

Another huge source of synthetic crude oil occurs in the Colorado oil shales in which the hydrocarbon occurs in shale beds, the costs of production appearing to significantly exceed the costs of oil production from the Athabasca oil sands.

It is basic to the concept of this invention, that, except for the relatively small areas adjacent the Athabasca river of low overburden, and therefore amenable to surface mining, any economic recovery of the major portions of the McMurray bitumen body will depend on the development of an economic underground mining method.

SUMMARY OF THE INVENTION of the Invention

The present invention contemplates, in its broader aspect, method and apparatus for the underground mining of deposits of particulate bedded material, in which a laterally-extending underground mining face is established of perhaps 1,000 ft. in width and from 10 to 12 feet in height, against which a laterally extending mining shield is positioned, the mining shield serving to partially enclose mining machinery such as lateral shearing ploughs, rotary cutters or the like which are conventional in underground coal mining, the cutter operating across the full width of the mining wall. The mined material, after being cut from the mining face, falls onto a lateral conveyor operating within the mining shield, and is then conveyed from the face to collecting means, operating at the ends of the face for ultimate conveyance through a shaft to the ground surface.

The mining shield comprises a plurality of individual arch sections, each individually advanceable towards the mining wall as the mining wall recedes, thereby creating a void posteriorly of the mining shield, leaving the "back" unsupported and permitted to collapse. Normally, the back will not subside for several hours after the advance of the shield, due to the "semi-plastic" nature of the sand and the entrained viscous bitumen. Under normal mining operations, the back will collapse gradually, 20 to 40 feet behind the moving mining shield as it advances into the bituminous sand body.

The operation will proceed for an optimum distance of forward travel, and is then repeated, to operate on the collapsed material as before. It will be appreciated that the entire operation takes place on, or adjacent the basement rock, the operation proceeding until the desired section of bituminous sand has been mined out.

The cutting equipment is not manned, the cutter travelling between a pair of operators, one at each end of the assembled movable shield each such operator being positioned in a pulpit in permanently supported manways.

Apparatus is also disclosed for attachment to the mining machine in order to adapt it to the specific requirements of underground bituminous sand mining, in which a pair of cleaner ploughs are retractably secured to the mining machine at each end thereof, for alternate action in following relationship to the mining machine and in leading relationship to the advancing apparatus for the mining arch sections, the purpose of which is to remove spalled detrital from the fresh cut which might otherwise impede the forward movement of the mining arch sections.

Apparatus is also disclosed for indexing the mechanism for advancing the mining arch sections.

It will be appreciated that the method of this invention is, in effect, a combination of "longwall mining", which is characteristic of coal mining, and "block-caving", which is characteristic of hardrock mining, in which the bituminous sand body is continuously block caved behind the advancing undercut of the longwall face, until the bituminous sand body is completely mined out, there being no attempt made to support the backs.

As the description of the method and apparatus of this invention proceeds, it will be appreciated that, although the principal application of the invention is in bituminous sands, the same may have application in shales having bitumen content, and other bedded deposits such as potash, nitrates, coal, and other friable minerals susceptable to the longwall/block-caving mining technique hereinafter described.

Since various modifications can be made to the invention herein described within the scope of the invention concept disclosed, it is not intended that protection of the said invention should be interpreted and restricted to the particular modification or modifications of known parts and methods of such concept as particularly described, defined, or exemplified, since this disclosure is intended to explain the construction and operation of such concept and it is not for the purpose of limiting protection by any specific embodiment thereof.

DESCRIPTION OF THE DRAWINGS

In the drawings, like characters of reference indicate corresponding parts in the several figures.

Proceeding therefore, to describe my invention in detail, reference should be made to the accompanying drawings in which.

DESCRIPTION OF THE PREFERRED EMBODIMENT(S)

Figure 4:
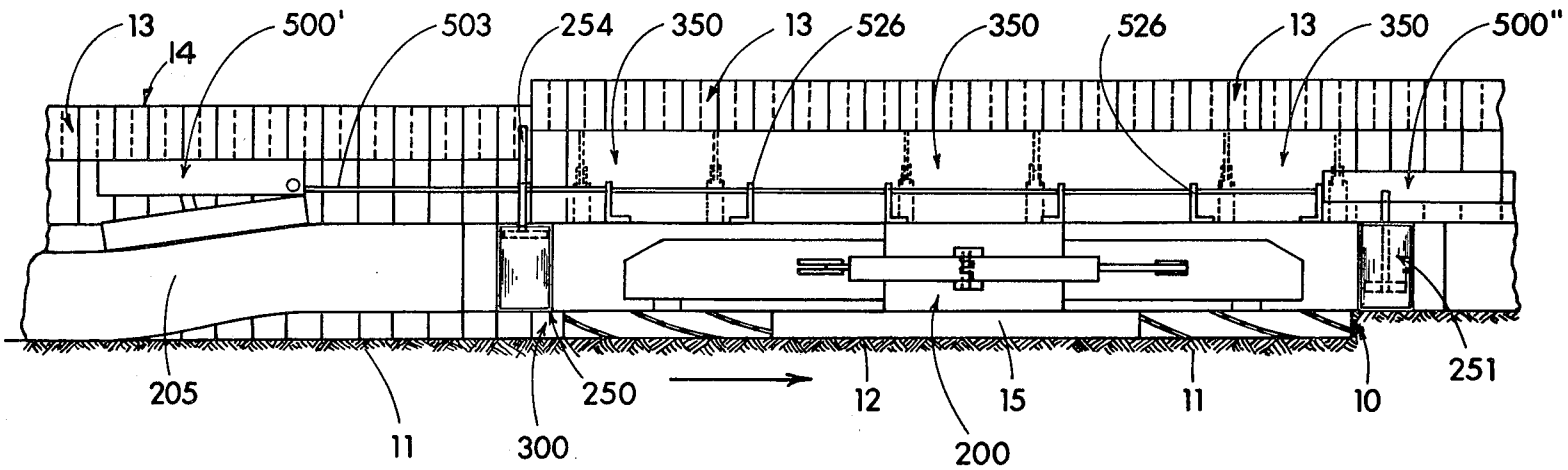
FIG. 4 is a horizontal partial cross-sectional view across the mining arch at 4–4 of FIGS. 2 and 3.

In the embodiment of the method of the invention illustrated in the drawings, the novel mining apparatus and method are being used to mine a body of bituminous sands by the simultaneous operation, in situ, of two working faces, the sand mineral from each active face being transported laterally from the work areas along each working face to perpendicular operating tunnels for conventional removal to the surface. The mining operation (ref. FIG. 4) is carried out from a vertical mining face 10 by applying the mining operation to a mining wall 11 of a desired depth over a work area 12 including the mine face 10. As the sand of the work area 12 is removed the work area 12 shifts back and forth along the mine face and the mining operation is thereby advanced forwardly into the unmined sand body. As is understood by those skilled in the art to which this invention relates, this general system of mining possesses important and well-known advantages.

The Mining Shield and Mining Arch Sections

In accordance with the present invention, a plurality of arch sections 13, FIGS. 1 to 4, co-operate to form a mining shield generally designated 14, extending over the work area 12 adjacent the active mining face 10 and longitudinally the full length of the mining wall. Individual arch sections of the mining shield are advanced progressively during the forward movement of the mining operation into the mining wall 11 established in the mining wall, as depicted in FIG. 4. The present invention also involves the use of a mining machine generally designated 200 which travels laterally along the mining wall 11, cutting progressively into an advancing mining face 10, established in the mining wall 11 and perpendicular thereto, as depicted in FIG. 4.

Figure 5:
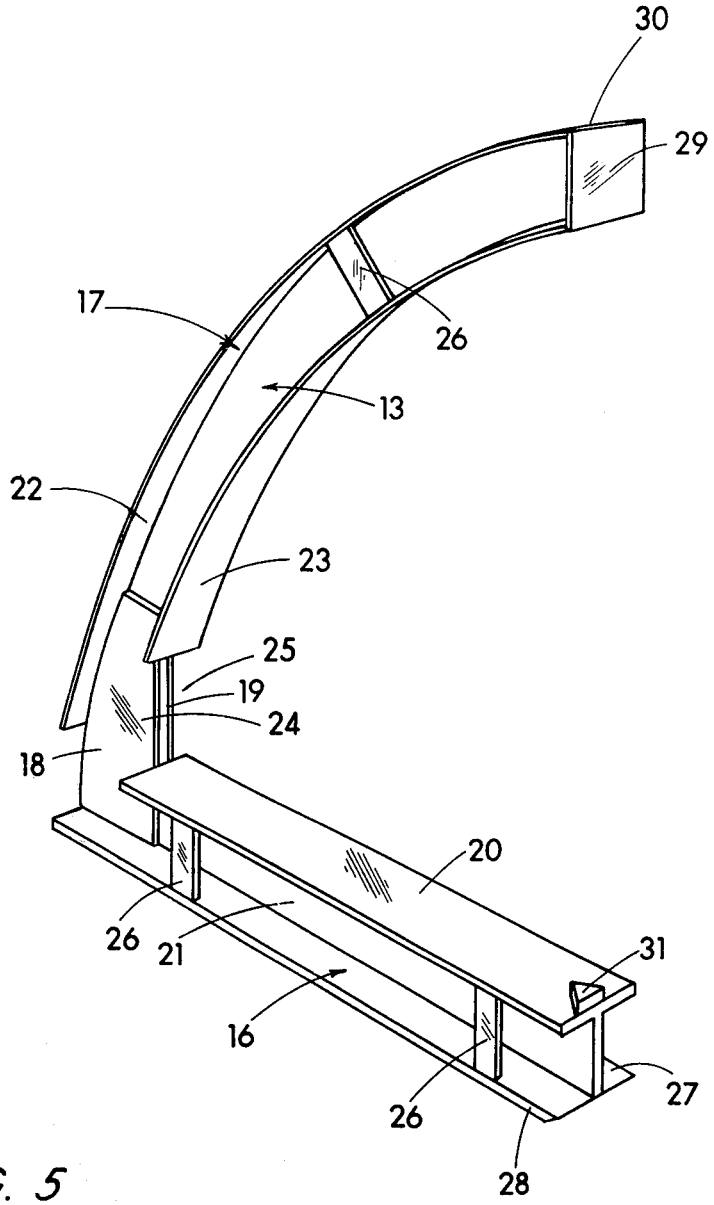
FIG. 5 is an enlarged perspective of a section of the mining arch.

The mining arch sections depicted generally at 13, FIG. 5, each comprise a base portion generally designated 16 and a cantilevered arch portion 17 rigidly secured thereto. For maximum strength-to-weight ratio, it has been found that an H-section for each of the base portion 16 and the arch portion 17, each of uniform and equal flange width, provides a practical design. A pair of gusset plates 18 and 19, secured by bolting or welding to the web 22 of the arch portion 17, and by bolting to an extension 20 of the web 21 of the base portion 16, permits replacement of the arch section components when required.

The inside flange 23 of the arch portion 17 is removed adjacent the base 16 as depicted in FIG. 5, to define a pair of openings 24 and 25 on either side of the pair of gusset plates 18 and 19, to permit introduction and engagement with the arch section of mechanism for forwardly advancing the arch section towards the mining wall after passage of the mining machine, as will be hereinafter explained.

Side plates 26, welded between the upper and lower flanges of the arch portion 17 and the base portion 16, serve to prevent inadvertent misalignment of adjacently abutting arch sections by preventing overlap of contacting flanges.

Figure 3:
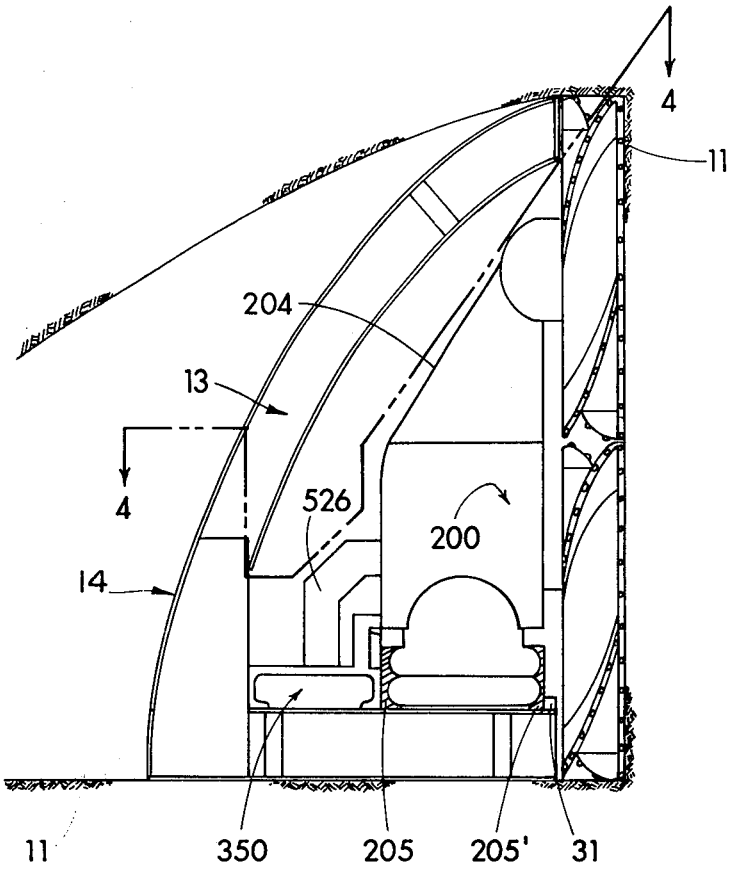
FIG. 3 is a vertical cross-sectional view through the mining arch of FIG. 1, at 3—3 of FIG. 1.

The forwardly extending end 27 of the base member 16 is provided with an upturn on the lower flange 28, as depicted in FIG. 5, in order to facilitate the forwardly sliding movement of the arch section over the ground surface upon which it rests when in operating position, as depicted in FIG. 3.

A bearing plate 29 is welded in vertical position across the forwardly extending end 30 of the arch portion 17.

A stop member 31, FIG. 5, is fixedly secured to the upper flange 20 of the base member 16, at its forward extremity as depicted in FIG. 5.

It will be apreciated that all arch sections 13 forming the mining shield 14 are identical, for interchangeability and to facilitate their functional co-operation with the mining, conveying and moving machiners, as will be hereinafter explained.

While the curvature profile of the arch portion 17 is obviously not capable of precise determination, the contour should be such that the overall height of the arch section will accommodate the mining machine and the associated conveying equipment, as will be hereinafter described. It will be appreciated that the arch portion 17 could also be a straight member extending forwardly and upwardly at an angle to the base portion 16. The width of the flanges of the base portion 16 and the arch portion 17 will be equal and will be determined by a compromise between the forward moveability of the arch section and the desirably minimum number of mining arch sections comprising a mining shield.

Figure 1:
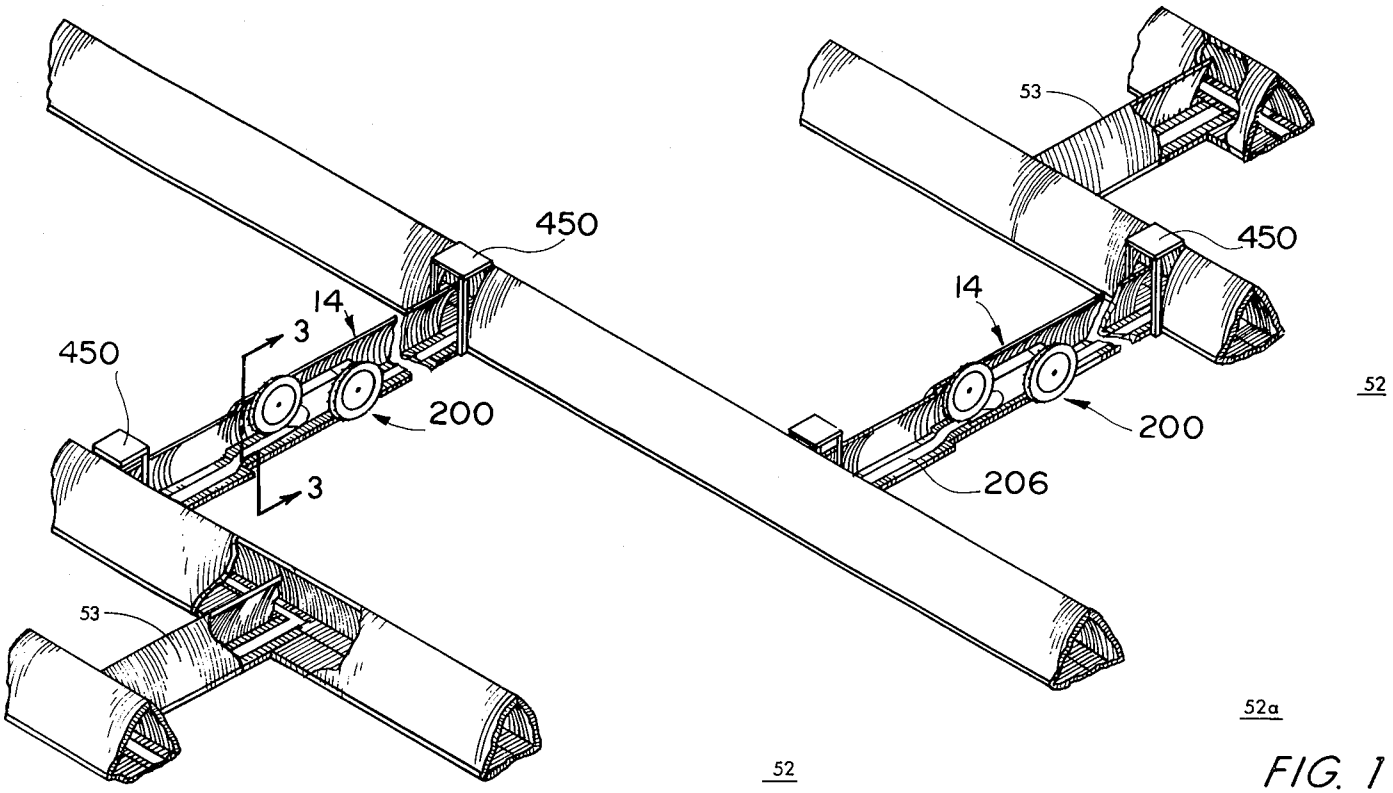
FIG. 1 is a perspective of a typical underground layout of a mine incorporating the method and apparatus of this invention, depicting the relationship of the mining face, operating pulpits and operating tunnels, the mining arch and mining and conveying machinery.
Figure 2:
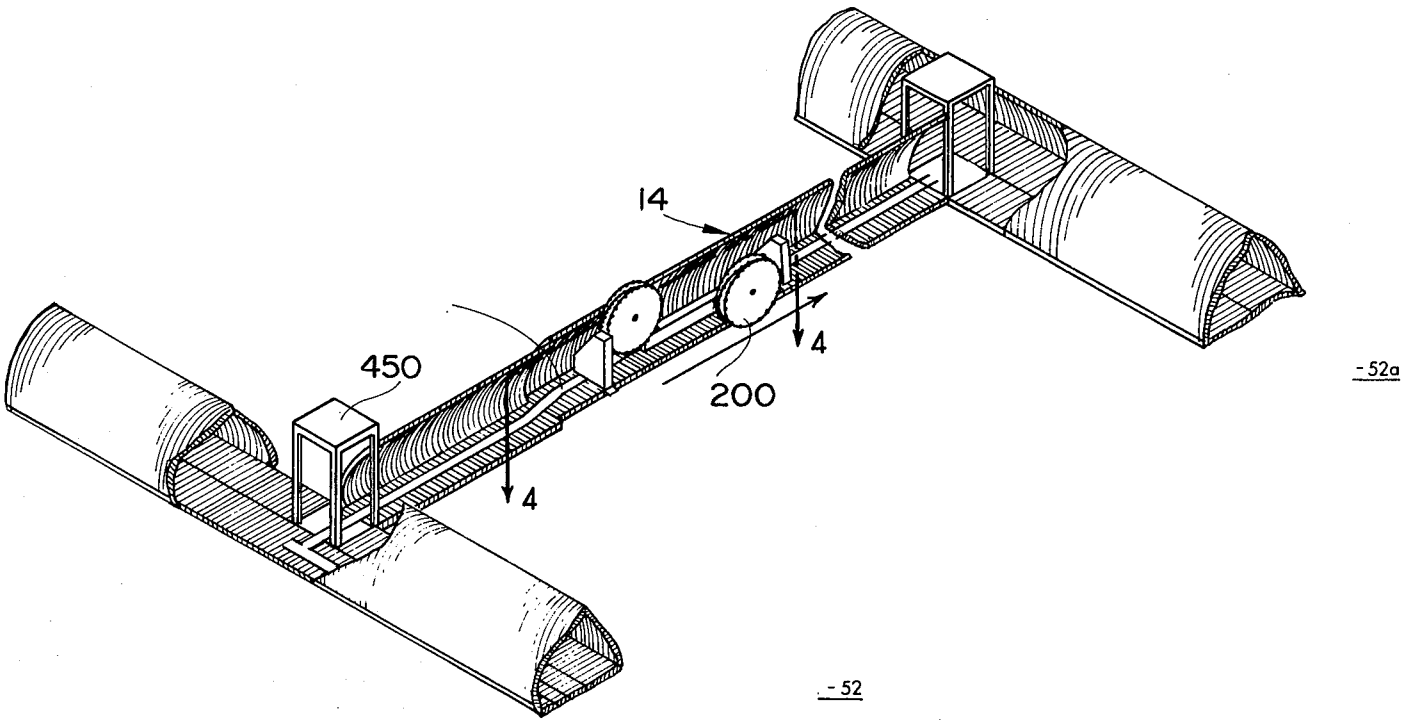
FIG. 2 is an enlarged perspective of one of the mining faces of FIG. 1 depicting the assembled mining arch and the mining and conveying equipment.

When a plurality of mining arch sections are displayed in aligned sideabutting relationship, as depicted in FIGS. 1 and 2, a laterally extending shield is formed, the roof of which is established by the adjacent arch portion 17, the base of which is formed in continuous fashion by the upper flange surfaces 20 of adjacent base portions 16.

The volume so formed within the shield will be open on one side which, in underground position will be the exposed mining wall 11 of FIGS. 1 to 4 inclusive.

Figure 5A:
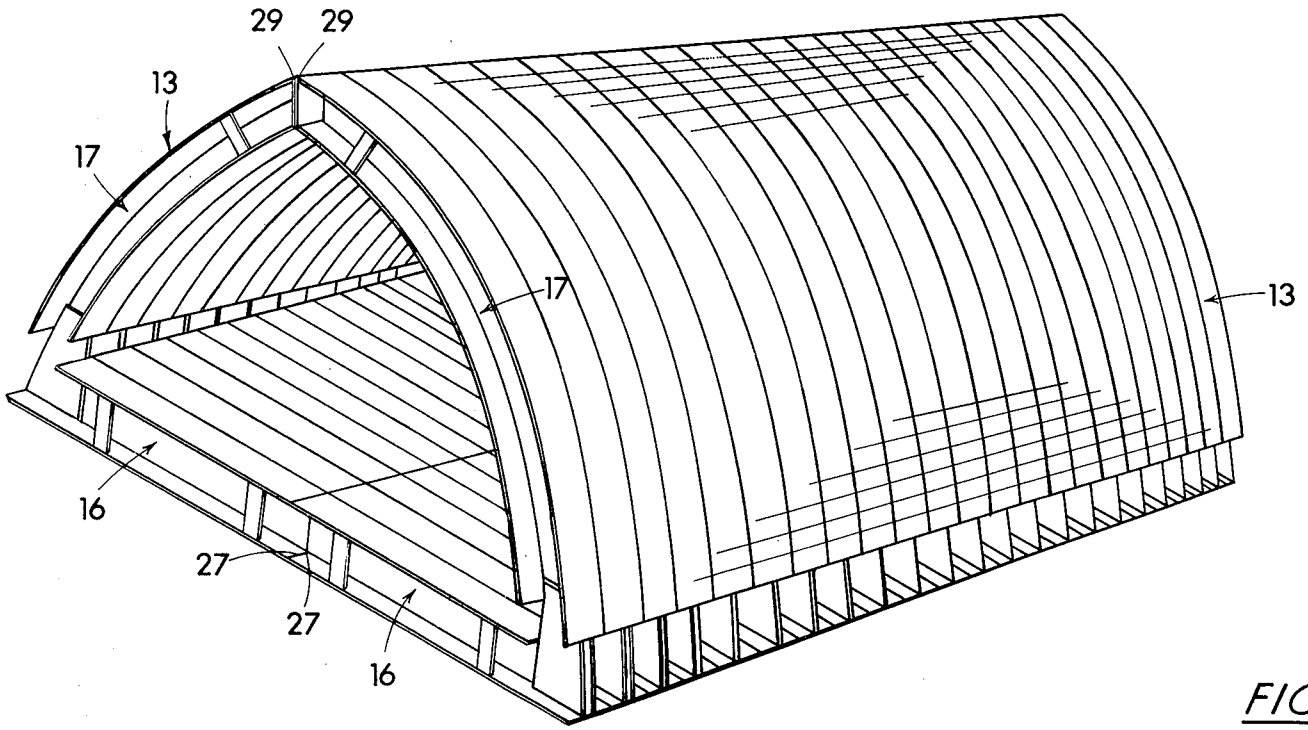
FIG. 5A is a perspective view of a tunnel structure formed by pairs of arch members arranged in alignment.

The mining arch sections 13 may be positioned in inwardly facing pairs, as depicted in FIG. 5A, with end plates 29 of the arch portions 17, and ends 27 of the base members 16 respectively, in contact.

Under loading from the exterior surfaces, the pair of arch members 13 so arranged will provide mutual support, and when arranged in aligned sideabutting relationship as depicted in FIGS. 1, 2 and 5A, a laterally extending enclosed tunnel is formed, which may be longitudinally extended or withdrawn as desired.

Mining Machinery and Conveying Machinery

The method and apparatus of this invention is used with longwall mining machinery of essentially conventional design, which will be familiar to those to whom this invention relates, and since the same forms no part of this invention, detailed descriptions thereof will not be included in this specification. In the drawing, and specifically FIG. 6, a shearer type longwall mining machine 200 is depicted, of a type commonly employed in longwall coal mining operations. Other types of longwall mining equipment such as ploughs and trepaners are useable with the apparatus and method of this invention, and the selection of the specific type of equipment will be dictated by the characteristics of the material to be mined.

In the shearer mining machine depicted in the drawings, a pair of rotary helical cutters 201, and 202, including a plurality of cutting teeth 203 mounted on the helix of the cutters 201, 202, are mounted in vertical aspect, each on a base-mounted, pivoted, powered arm 204. It will be appreciated that the face 10 of the sand body against which the cutters advance is perpendicular to the mining shield, as depicted in FIG. 4.

The base of the mining machine is mounted on a pair of rails 205, for lateral movement relative to the work area. The rails 205 function also as the side members of a conveyor, generally depicted at 206 (FIG. 4), which is mounted beneath the mining machine and between the rails 205; the conveyor is fed by gravity from the cutters 201, and 202, which discharge axially rearwardly onto the conveyor surface. It is conventional to drive the cutters from an electrical motor mounted on the base, powered from the mine power supply.

Figure 6:
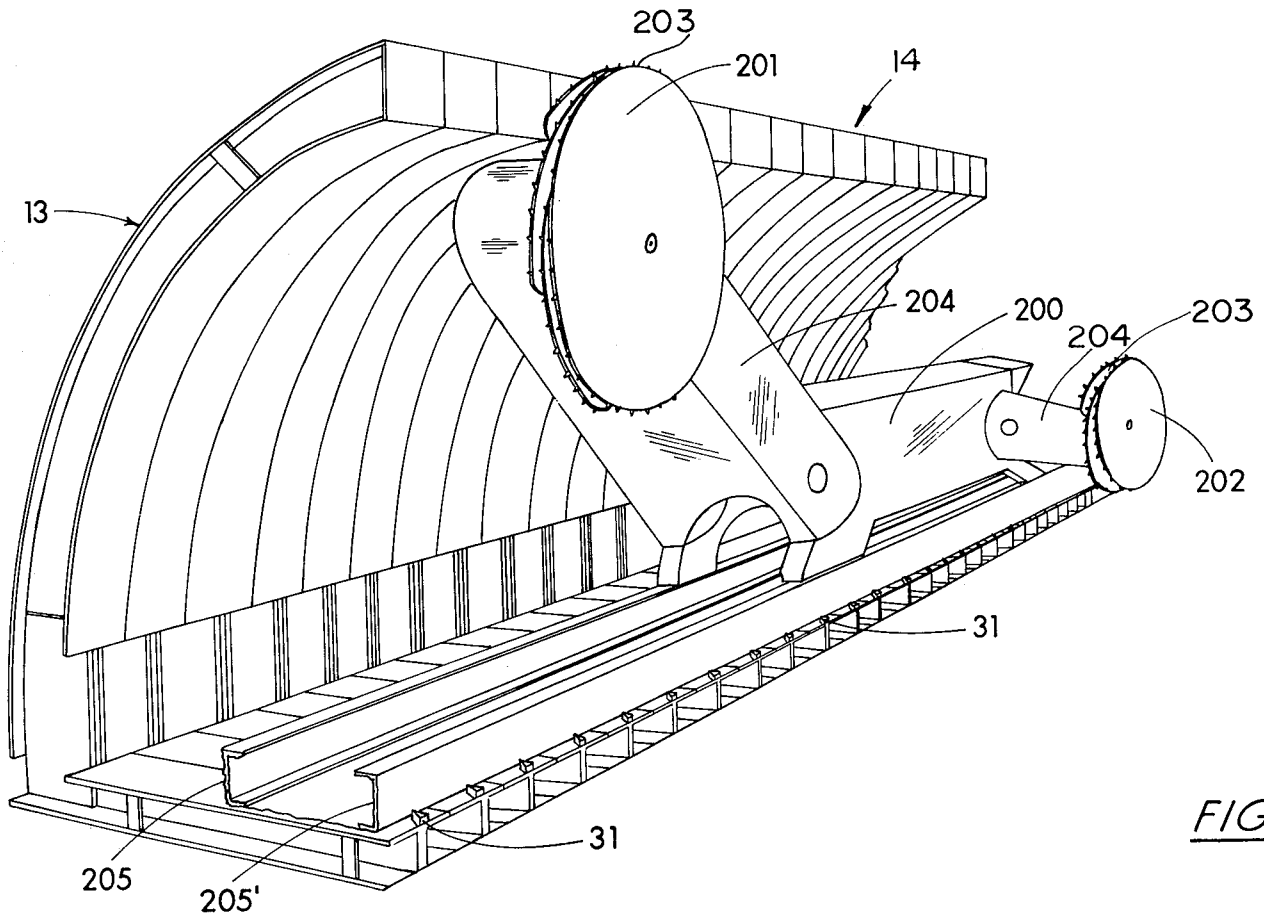
FIG. 6 is a perspective of a portion of the mining arch depicting the mining equipment and a section of the conveyor; with mining shield advancing apparatus, cleaning plough and mining machine guide assembly removed for clarity.

The rails 205 are laid on the adjacent upper flange surfaces 20 of the base portions 16 of the arch sections 13, and positionally limited by the outer stop members 31 mounted at the forward extremity of the base sections 16, as depicted in FIGS. 5 and 6. It will thus be appreciated that each arch section is permitted limited forward movement relative to the rails, from the position of abutting contact between the stop member 31 and the outer member of the pair of rails 205, while restrained from rearwardly movement from the same position by the stop member 31.

The embodiment of the conveyor depicted in the drawings is the flexible stationary chain type, in which moveable endless chains, attached to cross-bars, travel longitudinally within stationary conveyor pans, dragging the mined material longitudinally for conveyance therein. The pans are flexibly inter-connected so that the conveyor can be displaced horizontally to conform to the directional requirements of the operation. Again, since the conveyor forms no part of this invention, and its construction and operation will be familiar to those skilled in the art to which this invention relates, a detailed description thereof will not be included in this specification. It must be observed However, that provision is made in the method and apparatus of this invention for the lateral displacement of the conveyor towards the mining wall 11, by a distance equal to the depth of the mining face 10, after passage of the mining machine, in order to collect spalled material from the freshly cut mining wall 11. In the embodiment depicted in the drawings, such lateral displacement will be of the order of approximately 1 foot, and can be accomplished over a conveyor length of approximately 50 to 74 feet.

Mining Shield Advancing Apparatus

Advancing of the mining arch sections forwardly against the mining wall 11, as the mining machine moves longitudinally after having taken its cut from the moving face 10, is accomplished by the progressive and sequential forward movement of each arch section 13, as depicted in FIG. 4.

The depth of cut of the mining machine, which will be the width of the face 10, will be determined by the operating characteristics of the mining machine and the mining characteristic of the material being cut.

In FIG. 4, a pair of pneumatic powered jacks, generally designated 250, 251, are secured to the mining machine 200 at each end thereof as indicated in FIG. 4, and serve to advance the mining arch sections 13 the width of the cut, following passage of the mining machine. Such pair of jacks 250, 251, will operate alternately, depending on the direction of travel of the mining machine; as depicted in FIG. 4, in the direction of travel indicated, jack 250 will be operative and jack 251 will be inoperative.

The structure of the pneumatic jacks 250 and 251, and the means of indexing the operation thereof will now be described in detail, and reference should be made to FIGS. 7, 8, and 9 in this regard.

Figure 7:
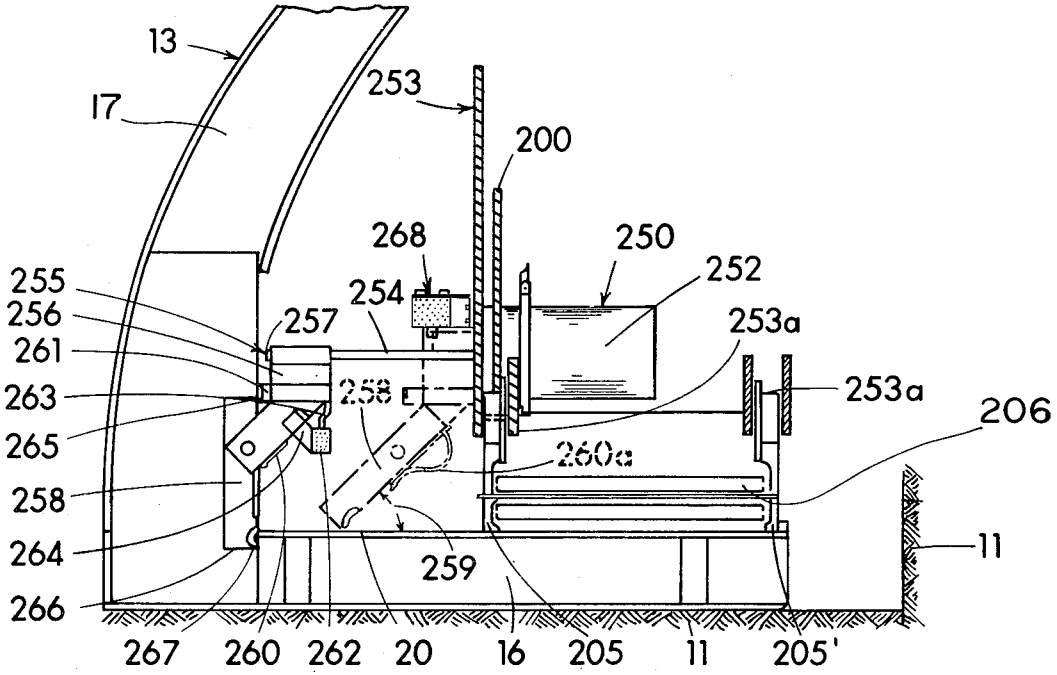
FIG. 7 is a vertical partial cross-sectional side view through a portion of the mining arch, depicting the equipment used for advancing the arch sections forwardly into the mining wall.
Figure 8:
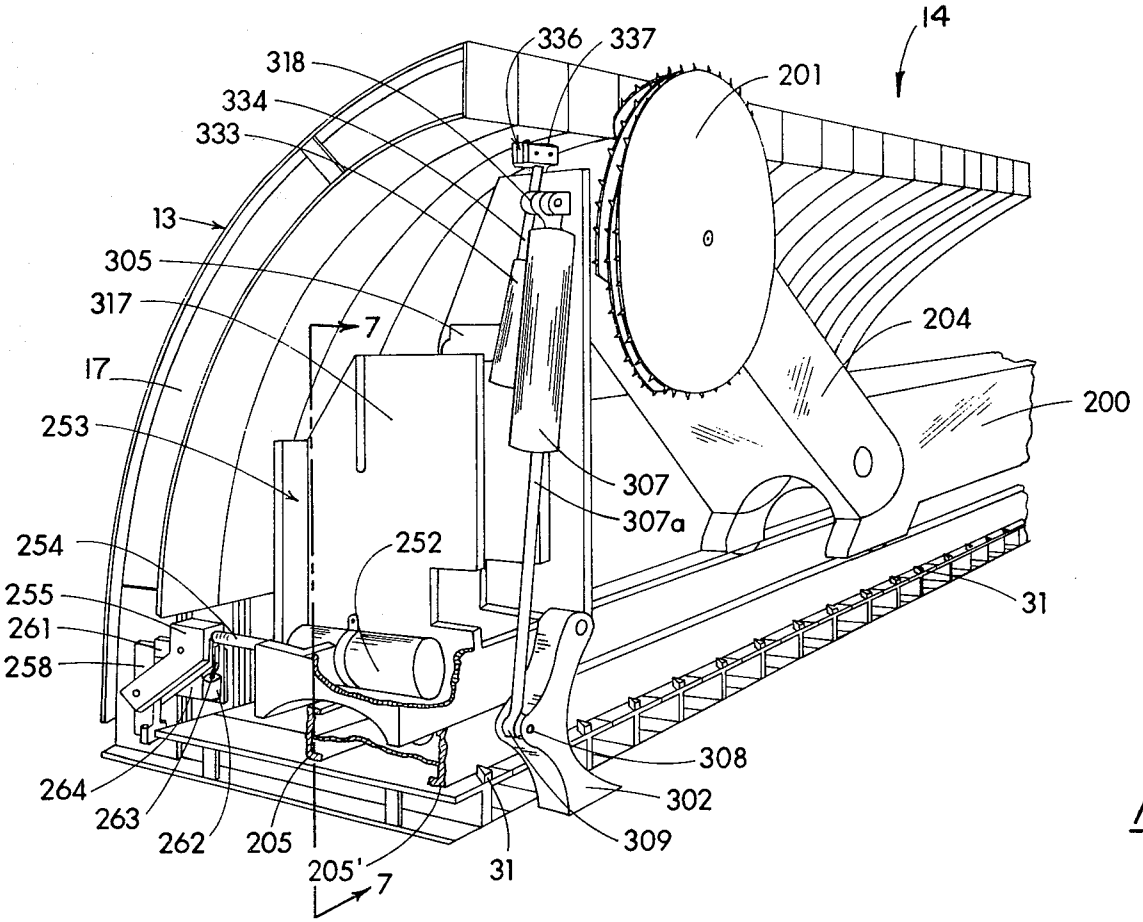
FIG. 8 is the mining arch portion of FIG. 6 with mining equipment, mining shield advancing apparatus, cleaning plough and mining machine guide assembly all in operating position.

The jacks 250, 251, each include a penumatic cylinder 252 mounted laterally to the mining shield upon a supporting frame 253 secured to the end of the mining machine 200, as depicted in FIG. 8. The inboard end of the framework is secured to the mining machine, while the outboard end is mounted upon a pair of rail-engaging track wheels 253 a, FIG. 7. The pneumatic cylinder activates a plunger rod 254, to which a yoke 255, is pivotally secured by a collar 256 and screw fitting 257 secured to the end of the plunger rod 254.

A puller bar 258, pivotally secured to the yoke 255, is of such length that it will rest normally at an angle 259 of approximately 45° to the upper flange surface 20 of the base portion 16 of the arch sections 13.

Figure 9:
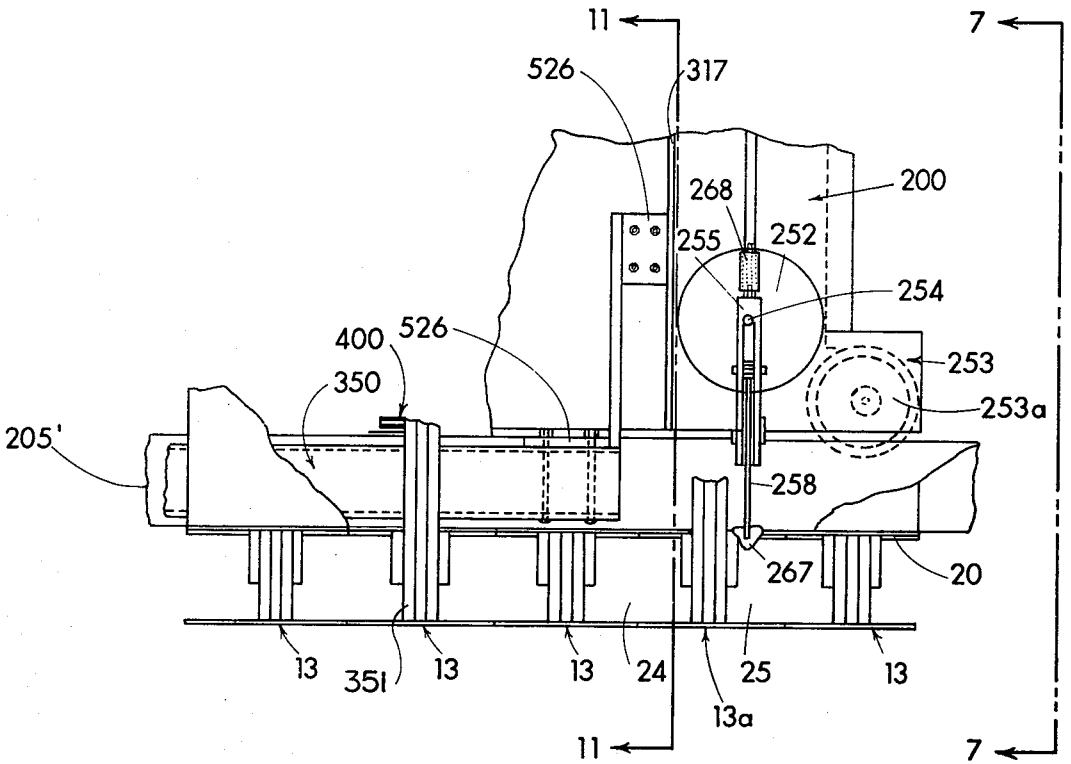
FIG. 9 is a vertical partial cross-sectional view of the arch advancing mechanism of FIGS. 7 and 8, viewed from the rear, with portions of the arches removed, for clarity; an alternative embodiment of the lower member of the mining arch, employing fabricated construction, is depicted.

When the pneumatic cylinder 252 is activated rearwardly and towards the upstanding wall of the shield 14, as will be hereinafter described, plunger rod 254 will move rearwardly so that the yoke 255 and puller bar 258 are inserted into one of the spaces 24 or 25 in the adjacent arch portion 17, as depicted in FIGS. 5 and 9. The puller bar 258 will drop downwardly into the void behind the cut-off top flange 20 of the arch section 13, and spring biasing 260 will urge the puller bar 258 into vertical aspect as depicted in FIG. 7, where it is locked by solenoid actuated catch means, as will now be described.

Reference to FIG. 7 depicts a puller bar catch 261, solenoid 262 and solenoid rod 263. Solenoid 262 is secured to the yoke 255 by mounting plate 264. When the solenoid 262 is activated, solenoid rod 263 will move the puller bar catch 261 into the position depicted in phantom in FIG. 7, thereby engaging the puller bar detent 265 and locking the puller bar into vertical position.

The distal end 266 of the puller bar 258 is formed in the configuration of a shallow hook 267, as depicted in FIG. 7, on its inward face, to engage the end of the flange 20. Activation of the pneumatic cylinder 252 in the reverse direction will move plunger rod 254 inwardly of the cylinder 252, thereby urging the mining arch section 13 into the mining wall 11 beneath the conveyor, an adjustably-selected distance of travel.

In order to release the puller bar from its engagement with the mining arch section, a limit switch 268 is provided on the framework 253, so positioned as to engage the yoke 255 at a selected inward limit of its travel. The limit switch 268 thus being closed, solenoid 262 is actuated and solenoid rod 263 moves puller bar catch 261 out of engagement with detent 265, thereby releasing puller bar 258 resuming its approximately 45° aspect to the horizontal, as plunger rod 254 moves further inwardly as depicted in phantom in FIG. 7.

When pneumatic cylinder 252 is reactivated into its outwardly moving or "push" condition, plunger rod 254 will move outwardly with yoke 255 moving out of engagement with the limit switch 268, permitting the switch to open, thereby deactivating solenoid 262; puller bar catch 261 is thus restored to its locking potential of securing puller bar 258 in vertical position as previously described. Puller bar 258, in the position indicated in phantom in FIG. 7, is enabled to slide laterally across the face 20 of the upper flange of the base member 16 of the arch section 13, as the mining machine moves forwardly.

In order to program the active member of the pair of pneumatic powered jacks 250, 251 for sequential operation in response to movement of the mining machine longitudinally along the mining wall, a sensor, generally indicated at 400 in FIG. 9, is mounted on the outer guide member 351. The sensor will thus move longitudinally of the mining arch 14 with the advance of the mining machine 200, and by sensing the position of the web 22 of the arch section 13, actuates the active member of the pneumatic powered jacks 250, 251, for actuation of its cycle, as heretofore described.

The sensor depicted in the preferred embodiment described in the drawings is of the electromagnetic type, in which the presence of conductive metal such as the gusset plates 18, 19 and arch web 22, FIG. 5, within the electromagnetic field of the sensor, will actuate relay switches in the circuit of the solenoid 262, FIG. 7.

Thus, the gusset plates 18, 19 and web 22 will actuate the solenoid 262, FIG. 7, of the arch advance mechanism, heretofore described. Adjustment of the program of the sensor 400 can readily be achieved by varying the position of the sensor 400 upon the guide member 351. Thus, the jack 250 will be actuated into its cycle for forward advance of the appropriate mining arch 13 into the mining wall 11, as is heretofore described. It will thus be apparent that an undulating "ripple" of forward movement of the mining arches will follow the movement of the mining machine down the length of the mining wall 11, reversable in direction when the mining machine 200 reaches the end of the mining shield 14.

Cleaning Plough

Figure 10:
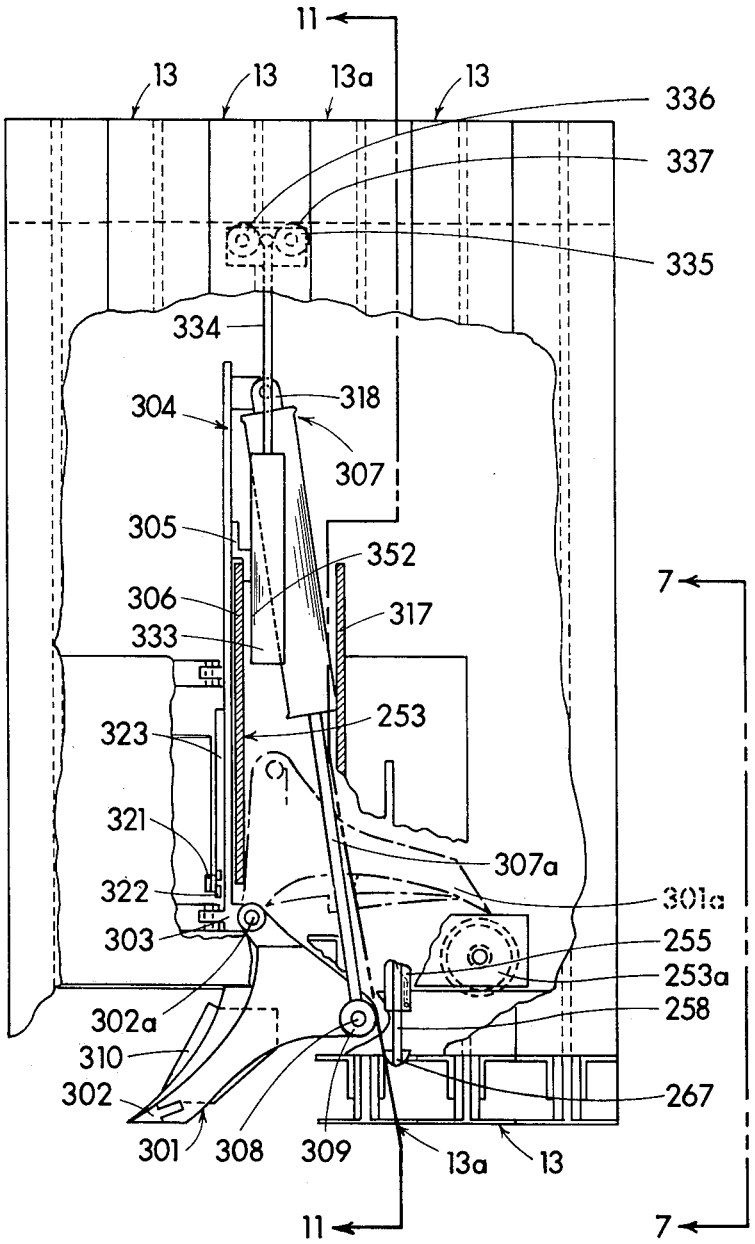
FIG. 10 is a side elevation, partially cross-sectional, of the cleaning plough and adjacent supporting structure at 10—10 of FIG. 11; the lower member of the arch section is similarly of fabricated construction. A portion of adjacent arch sections has been depicted in order to illustrate the juxtaposition of the plough, mining shield advancing apparatus and such adjacent arch sections.
Figure 11:
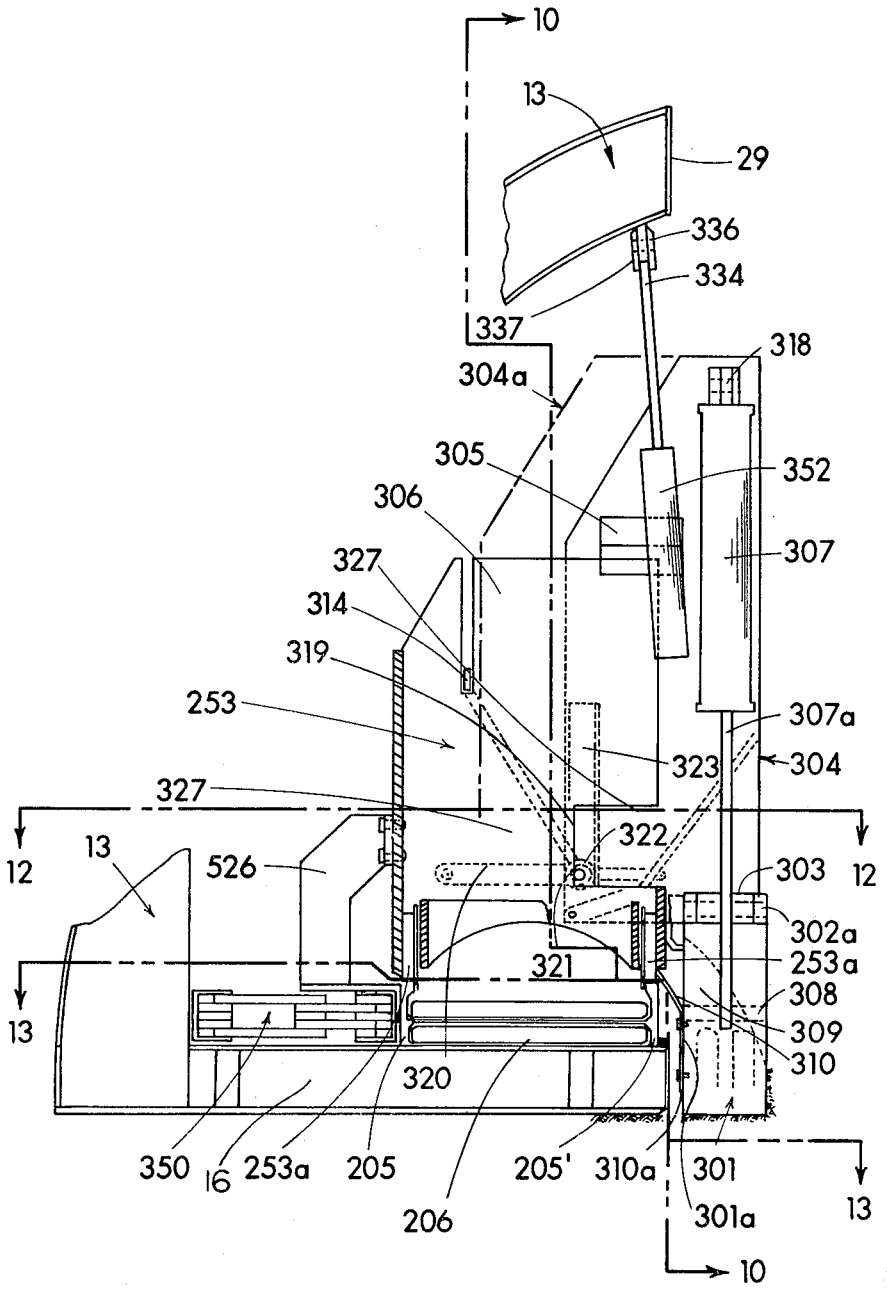
FIG. 11 is a vertical front elevation, partially cross-sectional, of the cleaning plough of FIG. 10, depicting its relation to the mining arch and associated apparatus.
Figure 12:
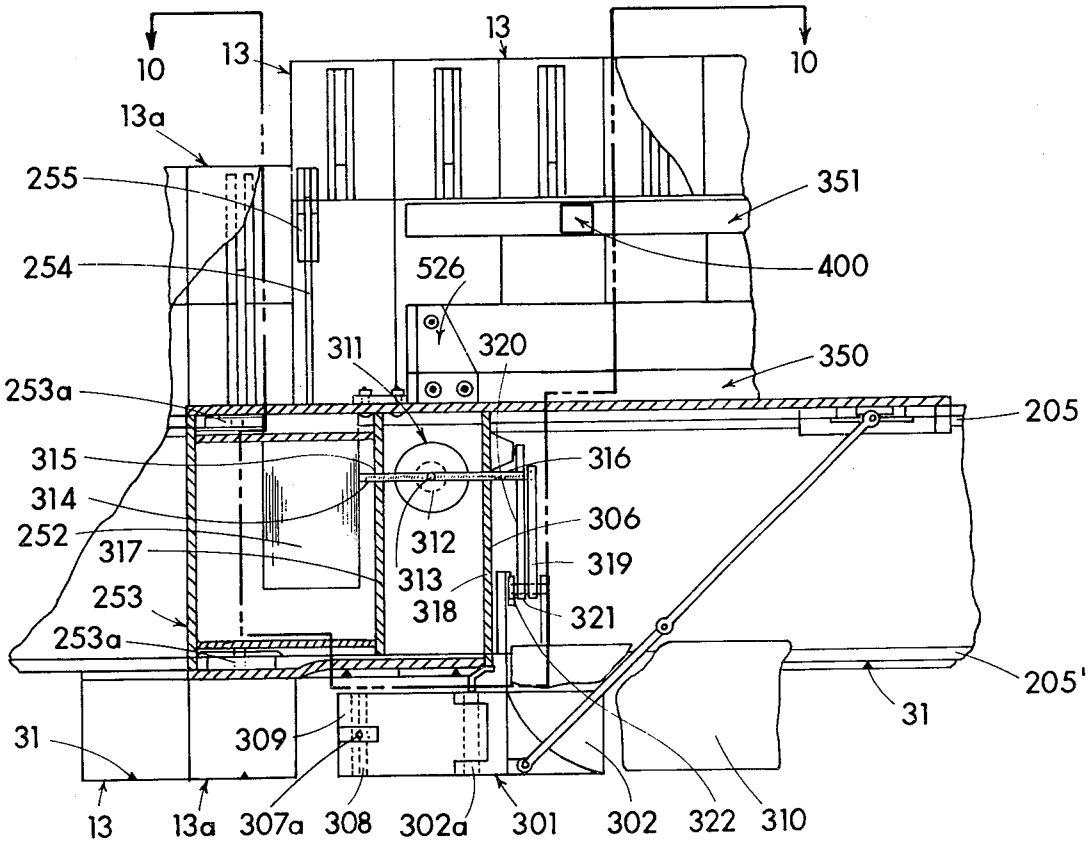
FIG. 12 is a top plan view, partially cross-sectional, of the cleaning plough of FIG. 10, additionally depicting the cleaning plough support assembly and the mining arch advancing mechanism.

Co-operatively functioning with the arch-advancing jacks 250, 251, just described, is a pair of cleaning ploughs 300, 301, operatively connected to the mining machine 200, and depicted generally in FIG. 6, and in detail in FIGS. 10, 11 and 12. These cleaning ploughs 300, 301, like the jacks 250, 251, operate in alternate sequence in conjunction with the associated member of the jacks 250, 251, depending on the direction of movement of the mining machine, as will be hereinafter explained.

In order to facilitate the forward moveability of the arch sections 13 towards the mining wall 11, the associated cleaning plough of the pair 300, 301, will immediately preceed the advance movement of the associated arch section, to ensure that the fresh cut in the mining wall 11 is clear of detrital spalled sand lying upon the floor surface of the space into which the arch is to be moved, as depicted in FIG. 11. The plough lifts the spalled detrital upwardly and inwardly to discharge it onto the conveyor.

As the cleaning plough and the associated jack are operative only in following relationship to the mining machine 200, the following member only of which is operative, the leading member being retractably withdrawn from operative engagement with the spalled detrital material.

Proceeding now to describe the cleaning ploughs in detail, reference may be made to FIGS. 10, 11, and 12, in which the cleaning plough, generally depicted at 301, includes a plough blade 302, pivotally secured on a stub axle 302A secured to the bottom end 303, of a mounting plate 304. Mounting plate 304 is suspended vertically and is adapted to be retractably withdrawn and extended into operating position by sliding laterally on a set of ways 305 engaging a vertical supporting plate 306 secured to the supporting framework 253.

A hydraulic lift generally designated 307, is provided, to selectively raise and lower the plough blade 302, into active position and withdrawn position as indicated in phantom, FIG. 10. The fixed end of the hydraulic lift 307, is secured to mounting plate 304 by means of a pivoted mounting bracket 305 and bearing plate 306, FIGS. 10 and 11. An actuating hydraulic rod 307A engages stub axle 308 on detent 309 of the plough blade 302, thereby adapting to pivot the plough blade around axle 302A counterclockwise as depicted in FIG. 10, out of engagement with the floor of the fresh cut in the mining wall 11. The contoured face of the plough blade 302 is such that the detrital material in the fresh cut in the mining wall 11 will be urged upwardly and laterally inwardly onto the conveyor 206, guided by a deflector plate 310 secured to the plough blade 302 on its interior surface 310(a). The mounting plate 304 is operated between its extended position indicated in full outline in FIG. 11 and its withdrawn position indicated in phantom outline in FIG. 11, by means of a separate pneumatic cylinder system generally designated 311, FIGS. 10, 11, and 12. The pneumatic cylinder 312 is mounted on the framework 253, and the plunger rod 313 of the pneumatic cylinder 312 is operatively connected to a yoke 314 operating vertically within vertical slot guides 315, 316, defined in each of a pair of vertical plates 317, 306, secured to the framework 253.

A link member 319 is pivotally secured at one end to the yoke 314 and inclines downwardly at its second end, where it engages a second link member 320, FIGS. 11 and 12 pivotally mounted on the vertical plate 306. Pivotal coupling of the pair of links 319 and 320 occurs at 321, by means of a roller mounting 322, operating in a vertical roller guide member 323 secured to the retractable plough mounting plate 304.

It will be appreciated that actuation of the pneumatic cylinders system will operate the yoke 314 and the attached link pair 319, 320, thereby operating the plough mounting plate 304 between its extended (operating) position, and its retracted (inoperative) position, depicted in phantom in FIG. 11.

Retraction of the plough mounting plate 304 must be restricted until the plough blade 302 is raised from its operating position when it will stow in the recess 327 formed in the plough mounting plate 304, FIG. 11.

Reference should now be had to FIGS. 10 and 11, for discussion of the means whereby the depth of cut of the plough blade 302 is regulated, with reference to the arch sections 13. This is accomplished by means of a downwardly thrusting hydraulic assembly indicated generally at 332, FIGS. 10 to 13. A hydraulic cylinder 333 is mounted on the plough mounting plate 304, slightly inclined from the vertical as indicated in FIG. 11, with plunger rod 334 extending upwardly therefrom towards the roof portions of the arch sections 13, and terminating in a pair of side mounted wheels 335, 336, which engage the under surface of the arch sections 13 adjacent their roof ends 337, FIG. 11. Powering of the cylinder 333 will restrain the plough downwardly, thereby resisting any tendency for it to lift out of engagement with the detrital at the bottom of the mining wall.

Reference to FIG. 10 will disclose the relative positions of the plough blade 302 with reference to the arch advance mechanism, the former being positioned only slightly ahead of the arch advance mechanism so that forward movement of each arch section will be accommodated by the freshly cleaned cut at the bottom of the mining wall.

It will be appreciated that when the mining machine reverses its direction, alternation of the active member of the pair of cleaning ploughs becomes necessary, as well as alternation of the active member of the pair of arch advance assemblies.

Mining Machine Guide Assembly

Figure 13:
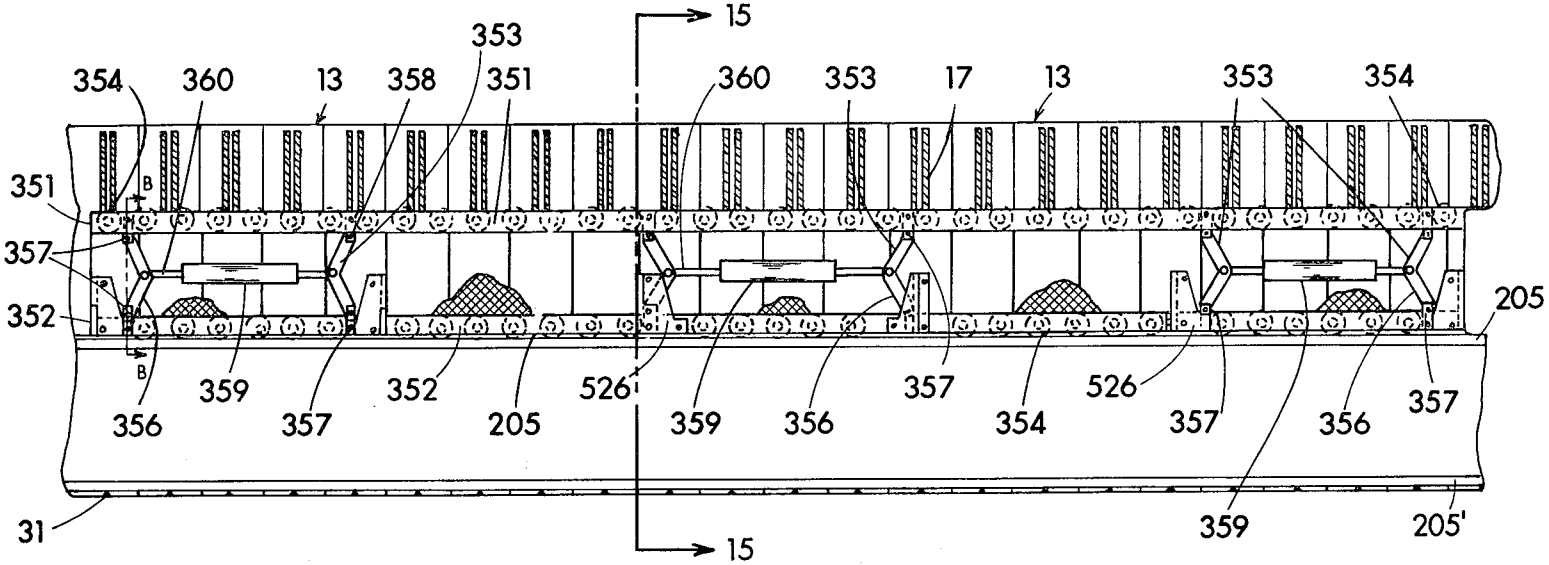
FIG. 13 is a horizontal partially cross-sectional view through a length of the mining arch at 13—13 of FIG. 11, depicting the mining machine guide assembly.
Figure 14B:
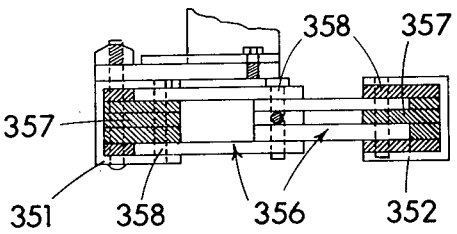
FIG. 14B is a section across the guide of FIG. 13, at B—B of FIG. 13, depicting the construction of the toggles.
Figure 14:
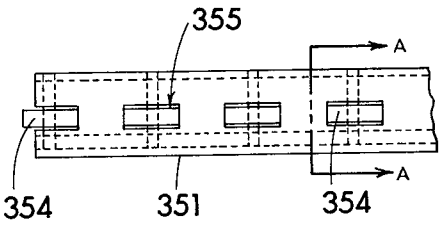
FIG. 14 is an elevation of the outer front face of a section of the guide of FIG. 13, depicting the bearing wheels.
Figure 14A:
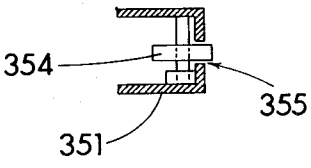
FIG. 14A is a lateral cross-section through a guide member, taken at A—A of FIG. 13.
Figure 15:
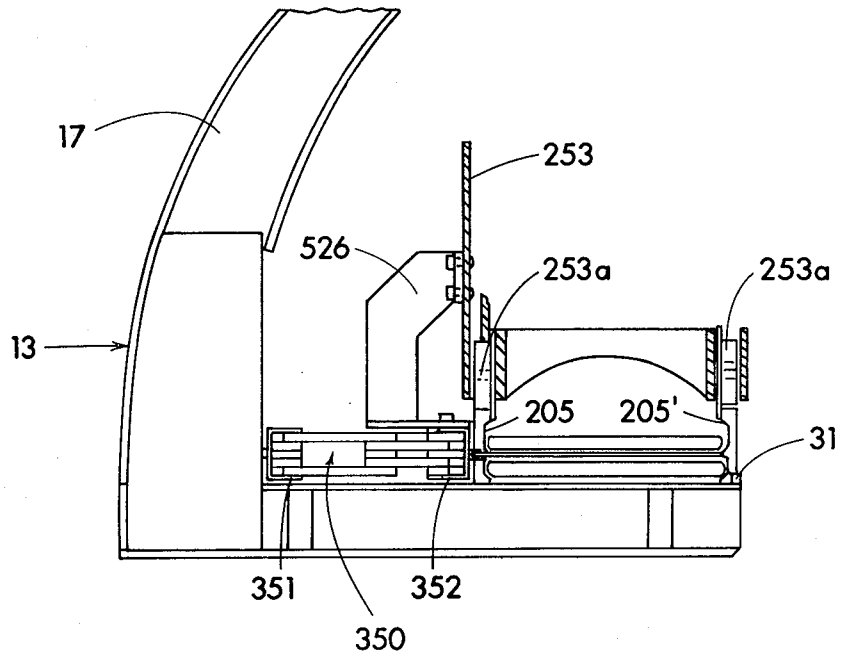
FIG. 15 is a vertical partially cross-sectional view through the mining machine guide assembly of FIG. 13, depicting the method of suspension and connection of the guide assembly.

Because of the heavy thrust loads on the mining machine when in operation, it is necessary to provide strong lateral support to the mining machine from the mining shield. In the apparatus and method of this invention, such support is provided by a guide assembly, generally designated 350 in the several drawings. Reference should be had specifically to FIGS. 13, 14 and 15 for discussion and details of the guide assembly 350.

In general terms, the guide assembly 350 comprises a pair of longitudinal members 351, 352, in parallel opposed relationship as indicated in FIG. 15, connected by linked toggle members generally designated 353, FIG. 13, which are hydraulically actuated to urge the longitudinal members laterally in opposition between the posterior of the mining machine and the mining arch sections 13 at the base of the arch portions 17, as depicted in FIG. 15.

In order to provide articulation of the longitudinal members 351, 352, at their respective contact surfaces with the mining machine and the arch sections 13, a plurality of flat surfaced bearing wheels 354 are axially mounted for journal rotation within the longitudinal members 351, 352, with a portion of their engaging surfaces protruding through apertures 355 formed therein, as depicted in FIGS. 13 and 14.

The longitudinal members 351, 352 are desirably deep channel sections, as depicted in FIG. 15, mounted with their respective webs facing outwardly.

Positioned in pairs at intervals between the longitudinal members 351, 352 are the toggle members 353, each of which comprises a pair of links 356, pivoted to the longitudinals 351, 352 by means of brackets 357 and axled bearings therein, 358. Between each pair of toggle members 353, is a double acting hydraulic cylinder 359, the plunger rods of which, 360, are pivotally connected to the toggle members 353, so that actuation of the hydraulic cylinders will cause relative horizontal displacement of the longitudingal members 351, 352.

It will of course be understood that any lateral thrust induced by the guide assembly on the mining machine will be resisted by the stop members 31 bearing against the outer member of the pair of rails, 205, FIG. 15. The guide assembly 350 will be suspended from the mining machine so that it will be out of contact with the base portion 16 of the arch section 13, as depicted in FIG. 15, by appropriate suspension brackets which will be adapted to the structure of the particular mining machine employed.

Because of the multiplicity of guide wheels 354, a significant number thereof are at all time in contact with the front faces of the arch sections 13, in order to distribute the horizontal thrust loads induced thereon by the expansion of the toggle members 353 therebetween.

The guide assembly 350 will be constructed in sections for disassembly when the mining machine is required to be moved through the operating tunnels depicted in FIG. 1.

Valving for the hydraulic cylinders 359 will be such that in operating condition, the plunger rods 360 will be urged outwardly as depicted in FIG. 13, thereby maintaining horizontal opposing forces on the mining machine arch sections 13.

The guide assembly 350 will be provided with a walkway 361 with articulated fastenings permitting relative displacement of the longitudinal members 351, 352, as heretofore described.

OPERATOR'S PULPIT

Reference to FIGS. 1 and 2 will disclose a box structure generally designated 450, at each end of the mining shield 14, which will now be discussed.

Normally, the mining shield 14 will not be manned, the mining machine operating in slow osolation between opposite ends thereof, the mined sand being conveyed along the mining wall to the ends thereof for delivery to one of the operating tunnels 52, depicted in FIGS. 1 and 2 for transportation to the mine shaft. However, at each end of the mining shield, a rectangular structure 450 is provided, for housing operating personnel and remote controls for the mining equipment.

Reference to FIGS. 1, 2, 16 and 17 will disclose the rectalinear design of the pulpit and their relationship to the operating tunnels 52 and the mining shield 14. The pulpit is open on all four sides, and comprises a reinforced roof section 451 and a floor section 452, and four similar H-beam columns 453, positioned at the corners thereof and secured as by welding.

Dimensionally, the roof and floor sections 451, 452 are desirably square, the side thereof being equal to the exterior dimension of the base of the arch sections 13, increased by the width of one cut of the mining machine, i.e., the width of the mining face 11, FIG. 4, for the reason hereafter set forth.

One pulpit of the pair will house the delivery end of the chain conveyor 206 and also the electric motor drive 454 for the chain conveyor. The conveyor 206 will discharge onto the main conveyor (not shown) in the operating tunnel, FIG. 1. The other pulpit of the pair will house the tail end assembly (not shown) of the conveyor 206.

Figure 16:
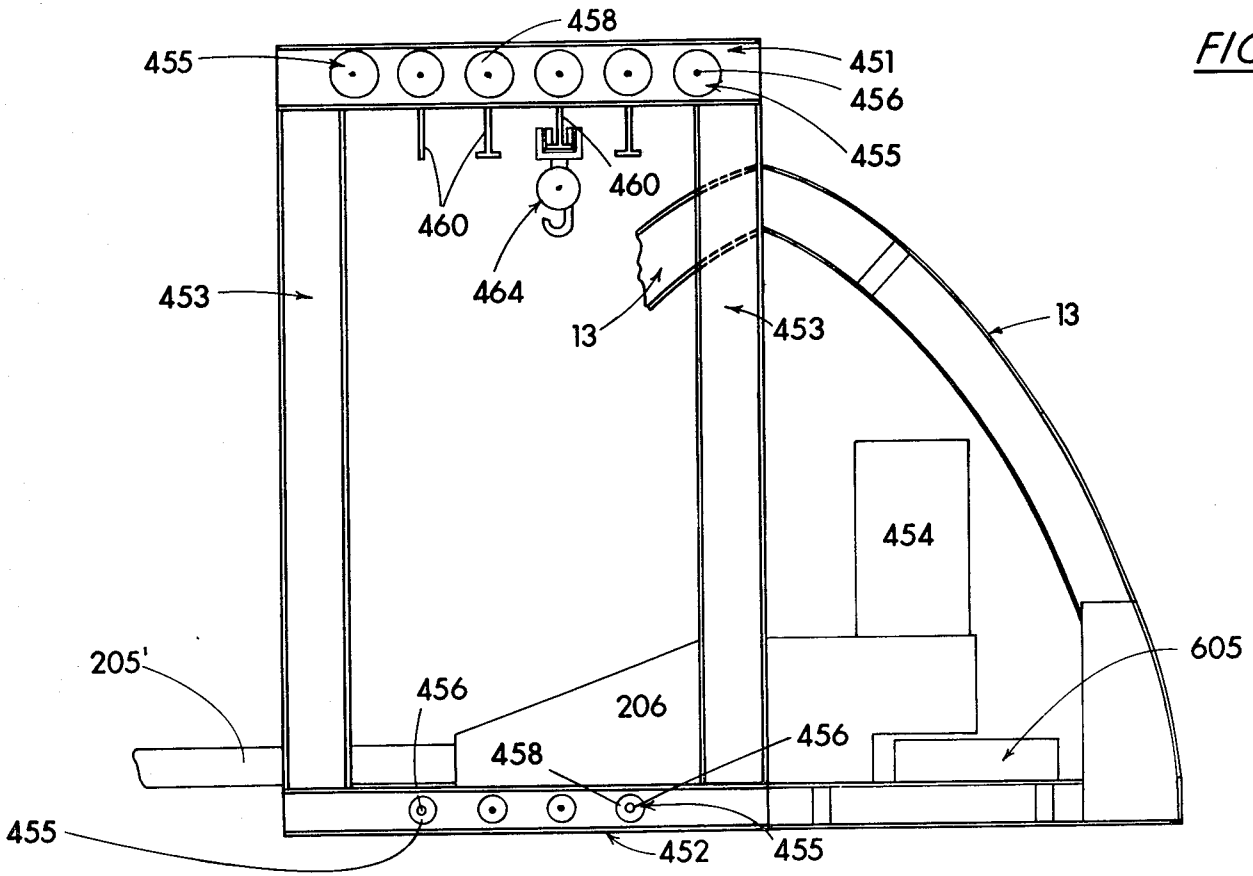
FIG. 16 and 17 are vertical elevations, viewed from the end and side respectively, of the operator's pulpit, with portions of mining arch members removed for clarity.
Figure 17:
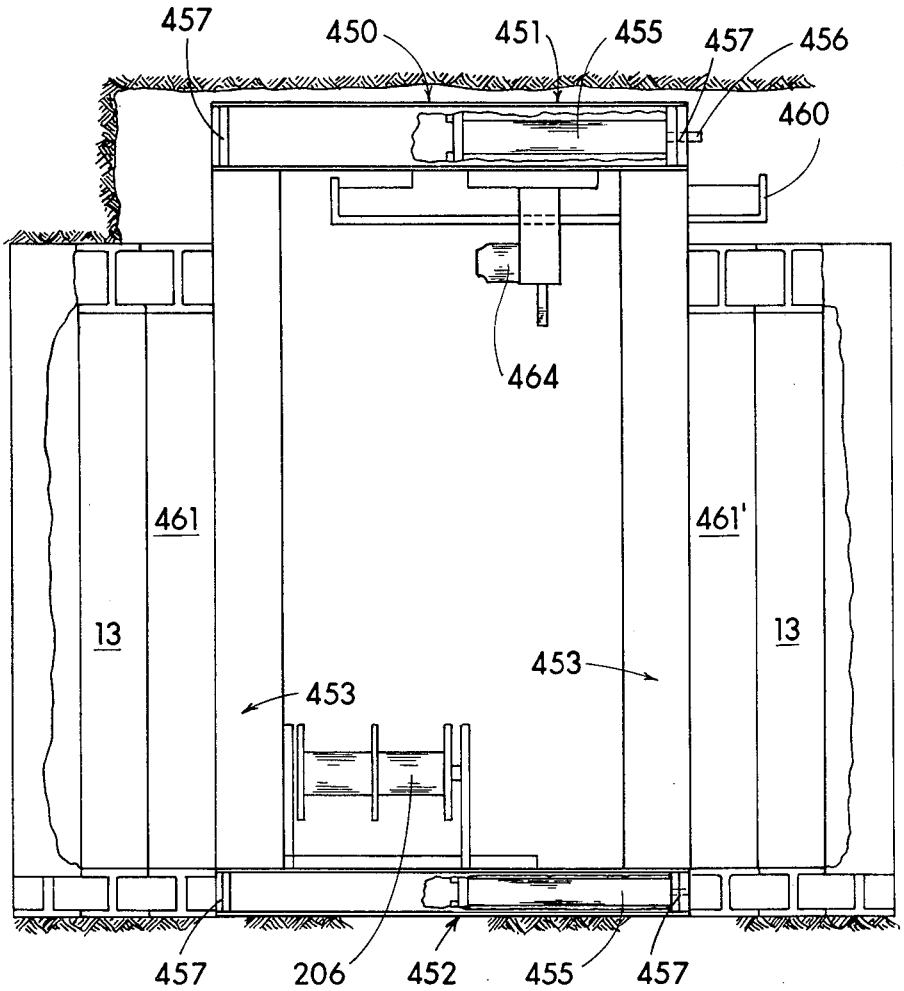

As depicted in FIGS. 16 and 17, the roof section 451 and floor section 452 are desirably constructed of H-sections to provide strength and support for the overhead crane depicted generally at 454.

Provision for advancing the pulpit forwardly in response to mining progress of the mining machine 200 is made by a plurality of pneumatic jacks 455 in both the roof section 451 and the floor section 452, as indicated in FIGS. 16 and 17, which will engage respectively, sand in situ and the side of adjacent tunnel arch sections 13, as depicted. The pneumatic jacks 455 are desirably mounted within the voids between adjacent H-members of the roof and floor sections 451, 452, and the plunger rods thereof, 456, will extend through apertures in the end plates 457, to connect with push plates 458, recessed into recess apertures 459 formed in the end plates 457.

When it is necessary to advance the pulpit forwardly in response to forward progress of the mining machine, the overhead crane will be run out on its track 460, to engage the next adjacent arch sections 461, 461, indicated in FIG. 17. The arch sections 461 will be lifted out of position on the overhead crane, and moved inside the pulpit. The pulpit will then be advanced into the void created by the removal of arch sections 461, by actuation of the pneumatic jacks 455 in the roof and floor sections 451, 452, whereupon the arch sections 461 will be installed at 465, FIG. 17, in the void thus created rearwardly of the pulpit.

KICKOVER FOR ADVANCING THE CONVEYOR

As has been heretofore mentioned, when the mining arch sections 13 are advanced forwardly against the mining wall 11, sequential to the longitudinal advance of the mining machine 200 along the mining wall, it is necessary that the conveyor 206 also be advanced forwardly against the mining wall, in close following relationship to the mining machine, so that the spalled material from the mining wall 11 will fall onto the conveyor 206, and not into the freshly-opened cut. It will be understood that the mining arch sections 13 are advanced beneath the conveyor rails 205, which are supported by the upper flange surfaces 20 of the base portions 16 of the arch sections 13, as depicted in FIG. 4 and 15.

Figure 18:
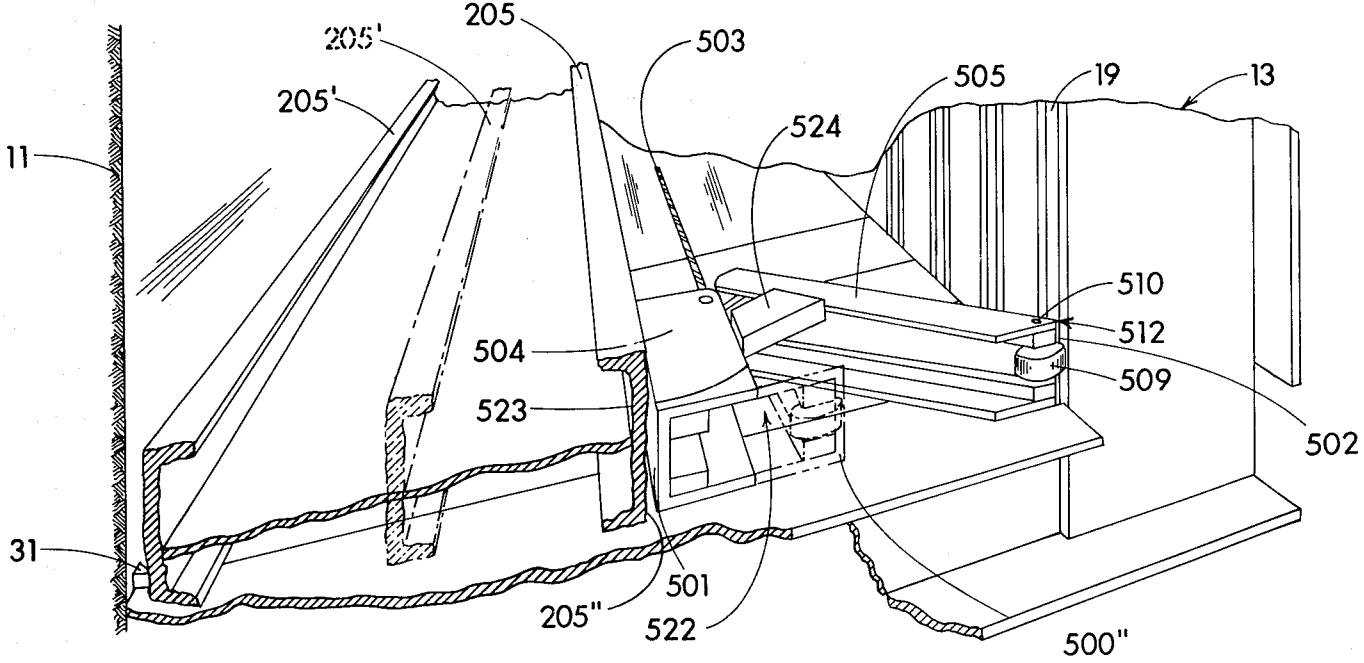
FIG. 18 is a horizontal partially cross-sectional perspective view through a length of the mining arch, depicting one member of the kickover pair in operating position.

The conveyor rails 205 are constructed in short sections, of the order of approximately 8 feet in length, with articulating connectors all as heretofore described, which permit maximum angular deflection between adjacently connected rail sections of the order of approximately 7½°, as depicted in FIG. 18. In order, therefore, to accomplish the lateral shift of the conveyor rails 205 into the mining wall 11 immediately following the mining machine, a kickover apparatus FIG. 18 to 20 inclusive, generally designated 500, FIG. 18, is provided which is towed in following relationship behind the mining machine, as depicted in FIG. 18.

The Kickover 500 is essentially a wedge which, when towed in following relation to the mining machine 200, engages with its inclined and roller mounted side surfaces 501 and 502 the interfaces 19 and 205'' of the arch sections 13 and the inside conveyor rail 205, FIG. 18, thereby causing lateral thrust on the inside conveyor rail and sidewards movement thereof from the position depicted in broken outline FIG. 18, to the advance position depicted in solid outline(18).

The kickovers 500 are connected in pairs, by the cable 503, so that the following member of the pairs 500', FIG. 4 will be operational and the other member 500'' will be in berthed position upon the mining machine. When the mining machine reaches the end of its travel along the mining wall the operation of the kickovers 500', 500'', will be reversed, the member 500'' being manually disengaged by the operator from its berthing position, and the other kickover member 500' in the leading position being automatically berthed on the mining machine, as will be hereinafter explained.

Figure 19:
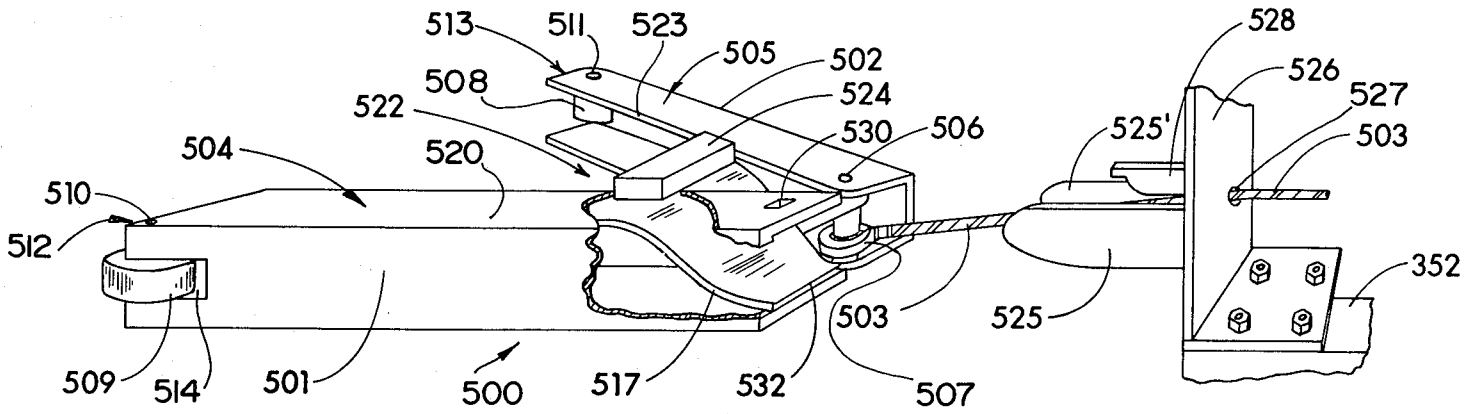
FIG. 19 is an isolated perspective view of the kickover, in partial cross-section, also depicting the berthing plates.

Considering now the construction of the kickovers 500 in detail, reference should be made to FIG. 19, which depicts the kickover as comprising generally two collapsably interlocking deep channel members 504, 505, pivoted together with open sides facing inwardly, at a first forward end about the vertical bearing 506, to which is anchored the interconnecting cable 503 by suitable cable clamping means 507. A pair of rollers 508, 509, are each mounted for rotation about vertical journal bearings 510, 511 respectively on the outer railing corners 512, 513 of the channel members 504, 505, so that their roller surfaces project therefrom through slotted apertures 514, and 515 (not shown), FIGS. 19 is formed in the side surface 501, 502.

Provision for locking the pair of channel members in the open or spread position is made by a flat spring member 517, positioned within the inner channel members 504 and fixedly secured at its one end 518, to the forward end 519 of the inner channel member 504. The spring member 517 is formed with compound curves as depicted in the drawings, inclined upwardly and rearwardly between the lower and upper flanges 520, 521 of the channel member 505. An aperture indicated generally at 522 but not shown in FIG. 19 in view of the partial section, is formed in the upper flange 520 of the inner channel member 504, so positioned as to align with the inner edge 523 of the outer channel member 505, when the pair of channel members 504, 505 are in the spread position, as depicted in FIG. 19. A detent stop member 524 is secured as by welding to the upper surface of the flat spring member 517, to engage the aperture 522 and to extend therethrough sufficiently to engage the inner edge 523 of the outer channel member 505, FIG. 19. When the spring member 517 is downwardly depressed to disengage the upper flange 520 of the channel member 504 the pair of channel members 504, 505 can be moved to their collapse position 500'', FIG. 18.

The lengths of the channel members 504, 505 are such that when locked in the spread position, FIG. 19, the overall distance between the extremes of the rollers 508, 509, will equal the distance between the interfaced 19 and 205'' of the arch sections 13 and the inside conveyor rail 205, prior to the advance of the mining arch section 13 towards the mining wall 11.

The kickover 500 is berthed with the mining machine 200 by engagement with a pair of berthing plates 525, 525', FIG. 19 welded to a mounting bracket 526 which is suspended from the mining machine 200.

Reference to FIG. 19 will depict the manner in which the interconnecting cable 502 is threaded through aperture 527, defined in the bracket 526 between berthing plates 525, 525'.

Figure 20:
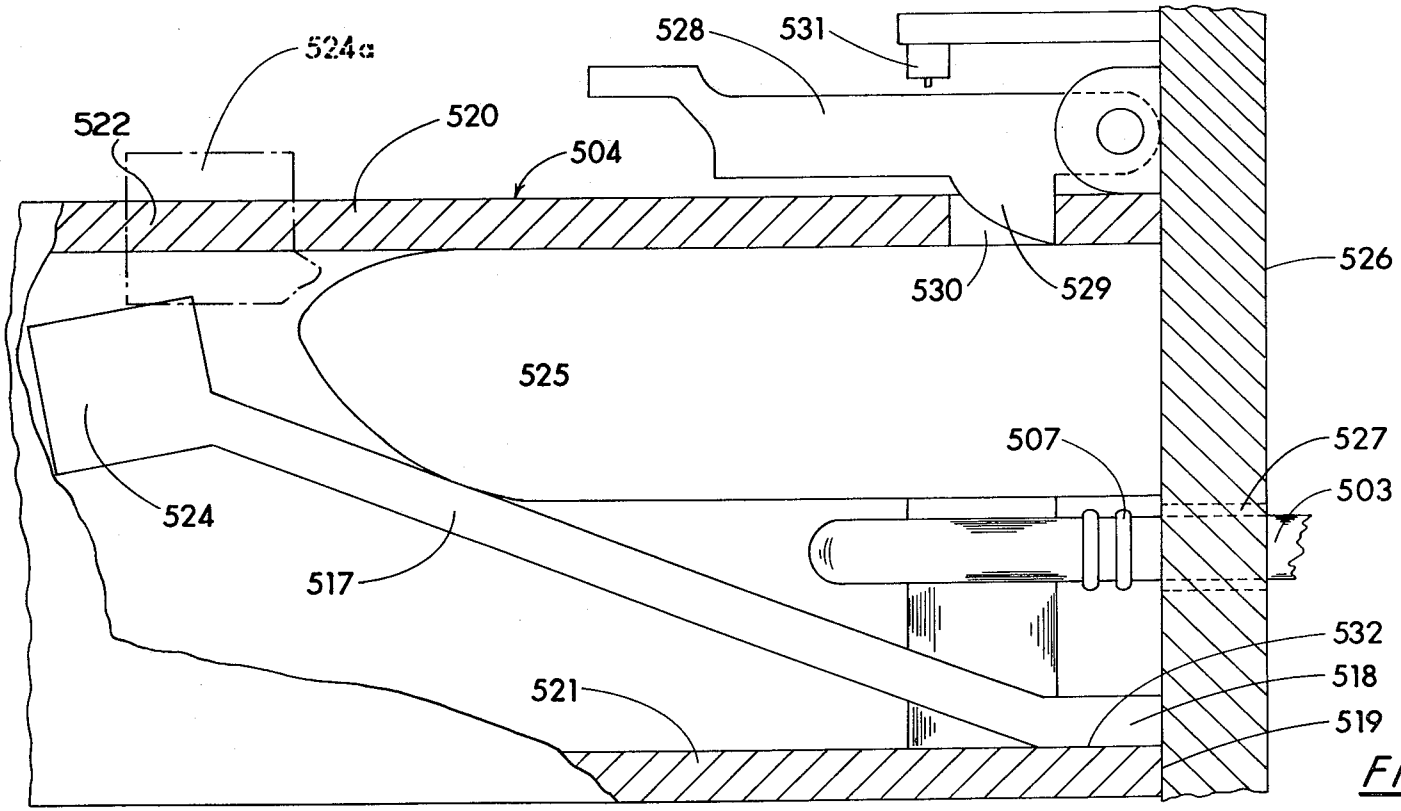
FIG. 20 is a detail of the berthing plates and mounting brackets. Corresponding and like parts are referred to in the following description and indicated in all the views of the accompanying drawings by the same reference characters.

The kickover is secured in the berthed position on the berthing plates 525, 525' by a catch member 528, FIG. 20, pivotally secured to the mounting bracket 526. A detent 529 on the catch member 528 engages an aperture 530 in the upper flange 520 of the outer channel member 504, so that the catch member 528 must be manually lifted before the kickover can be disengaged from the berthing plates 525, 525''. A sensor switch 531 actuates a signal to the operator in the operating pulpit 450, indicating the position of the catch member 528.

In operation, when the mining machine 200 has reached the end of the mining wall 11 and is prepared for reversal in its oscillating motion across the mining wall, the operator will manually release the catch member 528 from its engagement with the kickover 500'. Movement of the mining machine will cause slackening of the cable 503, and the kickover can be manually disengaged from the berthing plates 525, 525'' and dropped into towed operating position behind the advancing mining machine 200. The operator will move the channel members 504, 505 into the spread position, FIG. 18; movement of the mining machine forwardly into berthing engagement with the kickover 500'' will bring the cable 503 into taut engagement with the kickover 500'' in trailing movement behind the mining machine 200 for advance of the conveyor sections forwardly against the mining wall 11, as heretofore explained.

Operation

The operation of the apparatus and the procedural steps involved in the method will, no doubt, sufficiently appear from the foregoing description. It is, therefore, considered sufficient hereinafter to recapitulate in general outline only.

Access to the bituminous sand reserve will be established by means of vertical or inclined shafts, or alternatively, adits, by means of which the reserve is penetrated at its lower level adjacent the basement material.

The characteristics of the reserve will have been determined by preliminary core drilling, from which a mining plan will be established, in which at least two principal tunnels will be constructed, generally horizontally and parallel with one another and spaced apart a distance of the order of 2,000 feet. One of such horizontal tunnels 52(*a*) will serve as a manway/air duct and the other will serve as the operating tunnel, 52 for conveyance therein of major mining equipment and removal of mined bituminous material.

Such tunnels will be formed in the bituminous sands material by conventional tunnelling technology, in which the walls and overhead are supported by the installation of a double set of mining arches 13 of this invention, installed in inwardly facing pairs and in side-abutting relationship, as described. No interlocking of adjacent arches is necessary, the collapsing bituminous material being adequate to secure the arches in position.

When the initial location of the mining wall is determined, a pair of pulpits 450 will be established in each tunnel at opposite ends of the mining wall location, and a crosscut 53 will be driven between the tunnels at such location, the rear wall and overhead being supported by the installation of a single set of mining arches 13, in side-abutting relationship, as described, in order to form a mining shield 14. While under construction and when the mining and conveyancing machinery 200, 206, is being installed under the shield, temporary support of the mining wall 11 is provided by means of inwardly braced hording, which is removed when such equipment is operational.

The mining machine 200, powered electrically from the mine supply, is operated within the work area thus established, under the control of operators housed within the pulpits, and remotely controlling the mining machine therefrom, as clearly depicted in FIG. 2. The mining machine 200 will firstly be secured into operating position by actuation of the guide assembly 350, FIGS. 13, 14, and 15, the hydraulically operated toggle members 353 urging the mining machine into secure engagement with the mining arch members 13, between the inner flanges of the arch members 13 and the stop members 31 on the ends of the bases 16 of the mining arch members 13.

Mined bituminous material removed from the faces 10 established by each of the two rotary cutters 201, 202, will drop onto the conveyor 206, where it is transported to the communicating conveyor in the operating tunnel 52, FIG. 1, for ultimate transportation to the surface of the ground and stockpiling at the separation plant.

As the mining machine 200 advances along the mining wall, the cleaning plough 300 at the following end of the mining machine 200 will be actuated into engagement with the floor of the fresh cut established in the mining wall 11, in order to prepare the floor for the forward advance of the mining arch sections.

The electromagnetic sensor 400 located on the mining machine guide assembly 350, upon detecting the adjacent presence of the web/gusset plate metal mass 18/19, 22, of a program-positioned arch member 13, will actuate the arch advancing jacks 250 mounted on the mining machine in following relation thereto. The puller bar 258 will engage the program positioned arch member 13, located in close following relationship to the operative cleaning plough 300. The arch member 13 will be moved forwardly into the space created by the cut so established in the bituminous sands mining wall 11; the puller bar is then disengaged from the arch section 13, and will remain inactive until the program is repeated upon initiation by the sensor 400, as heretofore described.

As soon as the kickover cable becomes taut, the following kickover will become operative upon the conveyor 206, and will cause the conveyor sections in engagement with the kickover to displace outwardly in sliding fashion upon the upper surface 20 of the underlying base members 16 of the arch sections 13, and thereby to come into close proximity with the freshly cut mining wall 11, as depicted in FIG. 4.

When the operation has continued across the full width of the mining wall 11, it will be interrupted and proceedings will then be initiated for the turnaround of the mining machine 200. The first step in the turnaround procedure will be the advance of the pulpit 450 adjacent the then location of the mining machine 200. This is accomplished by the removal of the forwardly adjacent one or more mining arch sections supporting the walls and roof of the tunnel section incorporating such pulpit, and their reinstallation adjacently rearwardly of the pulpit 450 after the pulpit has been advanced along the tunnel by the width of the mining face 10, all as heretofore described in detail under the sub-head "Operators' Pulpit."

In order to advance the mining machine 200 into its new location in the mining wall 11, an initial work area will be hand mined in the mining wall adjacent the mining machine 200 at this location will each be forwardly displaced by manual jacking thereof the distance of the new mining face 10.

The kickover which had immediately theretofore been in operative following engagement behind the mining machine will now be in its inoperative berthed position on the mining machine, while the opposite kickover will be manually deberthed, as heretofore described in detail under that section of this disclosure under the sub-head "Kickover". When the kickover cable becomes taut, the kickover will come into operation in order to advance the flexible conveyor laterally into the freshly cut mining wall 11.

Thus, the mining, conveying, arch advance apparatus and kickover apparatus is again fully operational and will remain so until a full transverse has again been made of the mining wall 11 between tunnels, when the turnaround procedure will be repeated.

As the void behind the slowly advancing mining shield is gradually increased consequent on the successive forward movement of the mining arch sections, the unsupported backs overhanging the void will gradually slump downwardly, collapsing into the void so established, and onto the basement floor, so that when the mining operation has continued to the extremity of the block of bituminous material under exploitation, the direction of the mining operation will be reversed by reversing the orientation of each mining arch section 13 within the crosscut 53 between the tunnels. In this fashion, successive sweeps of mining operation will continue across the basement floor, until the bituminous sands reserve is fully mined out.

It will be understood, of course, that a plurality of mining operations will obviously be carried out simultaneously on the same bituminous sands body, operating in adjacent fashion, as depicted in FIG. 1.

The removal of the bituminous sands within the portion of the reserve under exploitation will ultimately cause subsidence of the ground surface overlying that portion, and it is suggested that the surface subsidence thus created would be useful for the disposal therein of waste sand from the oil extraction plant.

It will be seen, that this invention, as described herein, provides a practical and relatively inexpensive means of recovering bituminous sands, shale and like material where surface operations would be impractical.

In the foregoing description, the best known method of carrying out the process which form this invention, and utilizing the apparatus thereof, has been outlined. It is to be understood, however, that alterations and amendments may be made to the method and apparatus as described, by way of improvement, without departing from the spirit of this invention, and the principles involved as defined in the appended claims.

What I claim is:

1. A mining system comprising:

a. a pair of operating tunnels horizontally spaced in parallel relationship adjacent the base of a working block of mineral deposits, b. a mining shield comprising a plurality of arch sections arranged in side-by-side relationship and free of any permanent interconnection, each of said arch sections comprising a base portion forming a floor and a cantilever portion extending upwardly from said base portion at a generally acute angle and forming a roof, said mining shield extending between said operating tunnels such that the open side of the shield faces a mining wall, c. an operator's pulpit positioned in each of said operating tunnels at the end of said mining shield, c. mining equipment within said mining shield and movable along the length of said mining shield for making a mining cut while moving, e. means in said mining shield for conveying mine material to one of said operating tunnels, f. means for advancing said mining shield behind said mining equipment as said mining equipment progresses into the cut made by said mining equipment, and g. means for removing detrital from the mining space into which said mining shield is to be advanced.

2. A mining system as in claim 1 and wherein:

a. said operating tunnels comprise a plurality of oppositely disposed pairs of arch sections, b. said arch sections being free of any permanent interconnection.

3. A mining system as in claim 2 and wherein:

said operator's pulpit is open on all sides and has interior dimensions slightly larger than the exterior dimensions of said arch sections.

4. A mining system as in claim 3 and wherein:

a. said operator's pulpit includes moveable lift means for conveying said arch sections, b. jack means for moving said operator's pulpit in a direction parallel to transversally of said operating tunnel, c. whereby said arch sections forming the side of said operating tunnels nearest said mining shield may be individually lifted and moved into said operator's pulpit, said operator's pulpit advanced a distance equal to the width of said lifted and moved arch section, and said lifted and moved arch section replaced behind said advanced operator's pulpit.

5. A mining system as in claim 1 and including:

means associated with said mining equipment for laterally shifting said conveying means.

6. A mining system as in claim 5 and including:

means associated with said mining equipment for individually advancing said arch sections forming said mining shield toward the mining wall into the mined space behind said mining equipment.

* * * * *